US011715448B2

(12) United States Patent
Sato et al.

(10) Patent No.: US 11,715,448 B2
(45) Date of Patent: Aug. 1, 2023

(54) ELECTRONIC WIND INSTRUMENT AND METHOD FOR MANUFACTURING ELECTRONIC WIND INSTRUMENT

(71) Applicant: Roland Corporation, Shizuoka (JP)

(72) Inventors: Hitoshi Sato, Shizuoka (JP); Ryohei Kanayama, Shizuoka (JP)

(73) Assignee: Roland Corporation, Shizuoka (JP)

( * ) Notice: Subject to any disclaimer, the term of this patent is extended or adjusted under 35 U.S.C. 154(b) by 390 days.

(21) Appl. No.: 17/057,108

(22) PCT Filed: May 30, 2018

(86) PCT No.: PCT/JP2018/020670

§ 371 (c)(1),
(2) Date: Nov. 20, 2020

(87) PCT Pub. No.: WO2019/229862

PCT Pub. Date: Dec. 5, 2019

(65) Prior Publication Data

US 2021/0201873 A1 Jul. 1, 2021

(51) Int. Cl.
*G10H 1/34* (2006.01)
*G10H 1/00* (2006.01)

(52) U.S. Cl.
CPC ..... *G10H 1/34* (2013.01); *G10H 1/0008* (2013.01); *G10H 2220/275* (2013.01); *G10H 2220/361* (2013.01)

(58) Field of Classification Search
CPC .. G10H 1/34; G10H 1/0008; G10H 2220/275; G10H 2220/361

(Continued)

(56) References Cited

U.S. PATENT DOCUMENTS 11,594,205 B2 * 2/2023 Imamura ..... G10H 1/344
2012/0147570 A1 * 6/2012 Yamazaki ..... H01H 13/705 361/748

(Continued)

FOREIGN PATENT DOCUMENTS

GB 2462081 A * 1/2010 ..... G05G 9/04796
JP H01140595 9/1989

(Continued)

OTHER PUBLICATIONS

"Search Report of Europe Counterpart Application", dated Dec. 15, 2021, p. 1-p. 8.

(Continued)

*Primary Examiner* — Christina M Schreiber
(74) *Attorney, Agent, or Firm* — JCIPRNET

(57) ABSTRACT

The electronic wind instrument (1) includes an instrument body (10) in which a through-hole leading into an internal space (11) opens on an outer surface (12), an operation piece (20) attached to the instrument body (10) at a position of a through-hole (14) and pushed down toward the internal space (11), and an electronic component disposed in the internal space (11). The electronic component includes a push-down sensor (6) that detects that the operation piece (20) is being pushed down, and the outer surface (12) of the instrument body (10) comprises an outer wall (16*a*) that is provided around the through-hole (14) and that faces toward the through-hole (14), an inner wall (16*b*) that is provided nearer to the through-hole (14) than the outer wall (16*a*) and that faces toward the outer wall (16*a*), and a groove bottom (16*c*) connecting the outer wall (16*a*) and the inner wall (16*b*) together.

12 Claims, 5 Drawing Sheets

(58) Field of Classification Search
USPC ..... 84/644
See application file for complete search history.

(56) References Cited

U.S. PATENT DOCUMENTS

| | | | | |
|---|---|---|---|---|
| 2021/0065666 | A1* | 3/2021 | Terada | G10H 1/053 |
| 2021/0201872 | A1* | 7/2021 | Sato | G10H 1/32 |
| 2021/0201873 | A1* | 7/2021 | Sato | G10H 1/34 |
| 2021/0304714 | A1* | 9/2021 | Miyazaki | H04R 1/028 |

FOREIGN PATENT DOCUMENTS

| | | | |
|---|---|---|---|
| JP | H01140595 | U * | 9/1989 |
| JP | H02111198 | | 9/1990 |
| JP | H0333490 | | 4/1991 |
| JP | H0333490 | U * | 4/1991 |
| JP | H0335595 | | 4/1991 |
| JP | H0335595 | U * | 4/1991 |
| JP | H05204377 | | 8/1993 |
| JP | H01140595 | U * | 4/1998 |
| JP | 2006189912 | | 7/2006 |
| JP | 3931838 | B2 * | 6/2007 |
| JP | 2011002589 | | 1/2011 |
| JP | 2012128123 | | 7/2012 |
| JP | 2013254659 | | 12/2013 |

OTHER PUBLICATIONS

Office Action of European Counterpart Application, dated Sep. 7, 2022, pp. 1-5.

"International Search Report (Form PCT/ISA/210)"of PCT/JP2018/020670, dated Aug. 7, 2018, with English translation thereof, pp. 1-4.

* cited by examiner (a)

(b)

ELECTRONIC WIND INSTRUMENT AND METHOD FOR MANUFACTURING ELECTRONIC WIND INSTRUMENT

CROSS-REFERENCE TO RELATED APPLICATION

This application is a 371 application of the International PCT application serial no. PCT/JP2018/020670, filed on May 30, 2018. The entirety of each of the above-mentioned patent applications is hereby incorporated by reference herein and made a part of this specification.

TECHNICAL FIELD

The present invention relates to an electronic wind instrument in which moisture can be impeded from infiltrating an instrument body through a through-hole for an operation piece.

BACKGROUND ART

Conventionally, an electronic wind instrument that generates a musical tone based on an operation of a performer blowing exhaled breath into a blow port and pressing an operation piece is known (Patent Literature 1). The electronic wind instrument disclosed in Patent Literature 1 includes an instrument body in which a through-hole leading into an internal space opens on an outer surface, an operation piece which is partially inserted into the through-hole and is attached to the instrument body, and an electronic component which includes a push-down sensor for detecting that the operation piece is pushed down and which is disposed inside the instrument body.

CITATION LIST

Patent Literature

[Patent Literature 1]
Japanese Utility Model Application Laid-Open No. H2-111198

SUMMARY OF INVENTION

Technical Problem

However, in the above-described related art, moisture in the exhaled breath of the performer that has condensed on the outer surface of the instrument body may infiltrate the internal space of the instrument body through the through-hole for the operation piece along the outer surface of the instrument body. When the moisture adheres to the electronic component inside the instrument body, there is concern that malfunctions or failures may occur in the electronic component.

The invention is contrived to solve the above-described problems. An objective of the invention is to provide an electronic wind instrument in which moisture can be impeded from infiltrating an instrument body through a through-hole for an operation piece.

Solution to Problem

In order to achieve this objective, an electronic wind instrument of the invention includes: an instrument body in which a through-hole leading into an internal space opens on an outer surface; an operation piece which is attached to the instrument body at a position of the through-hole and is pushed down toward the internal space; and an electronic component which is disposed in the internal space, wherein the electronic component includes a push-down sensor which detects a push-down state of the operation piece, and wherein the outer surface of the instrument body includes an outer wall which is provided around the through-hole and faces toward the through-hole, an inner wall which is provided nearer to the through-hole than the outer wall and faces toward the outer wall, and a groove bottom which connects the outer wall and the inner wall.

Figure 1:
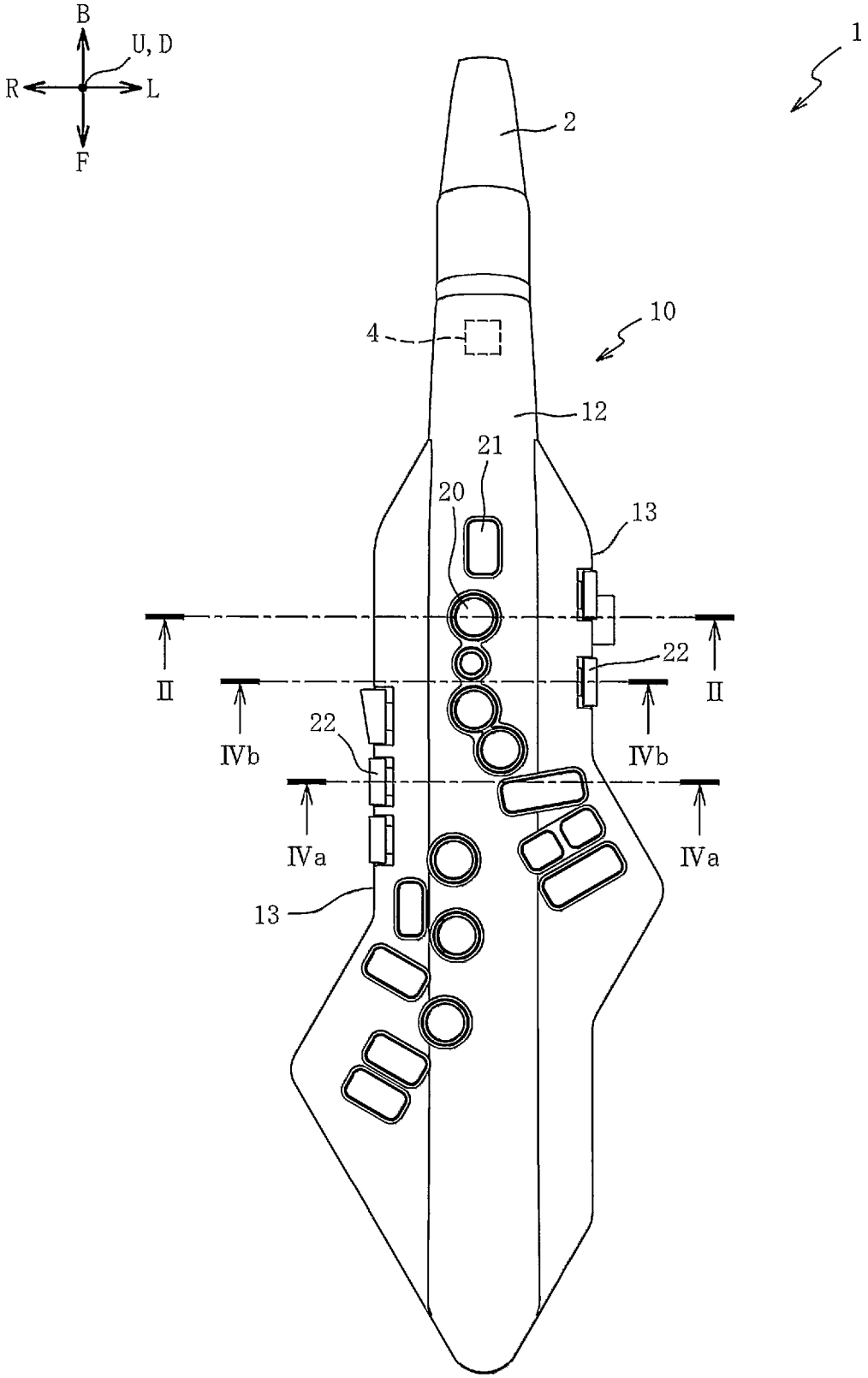
FIG. 1 is a plan view of an electronic wind instrument of a first embodiment.
Figure 4:
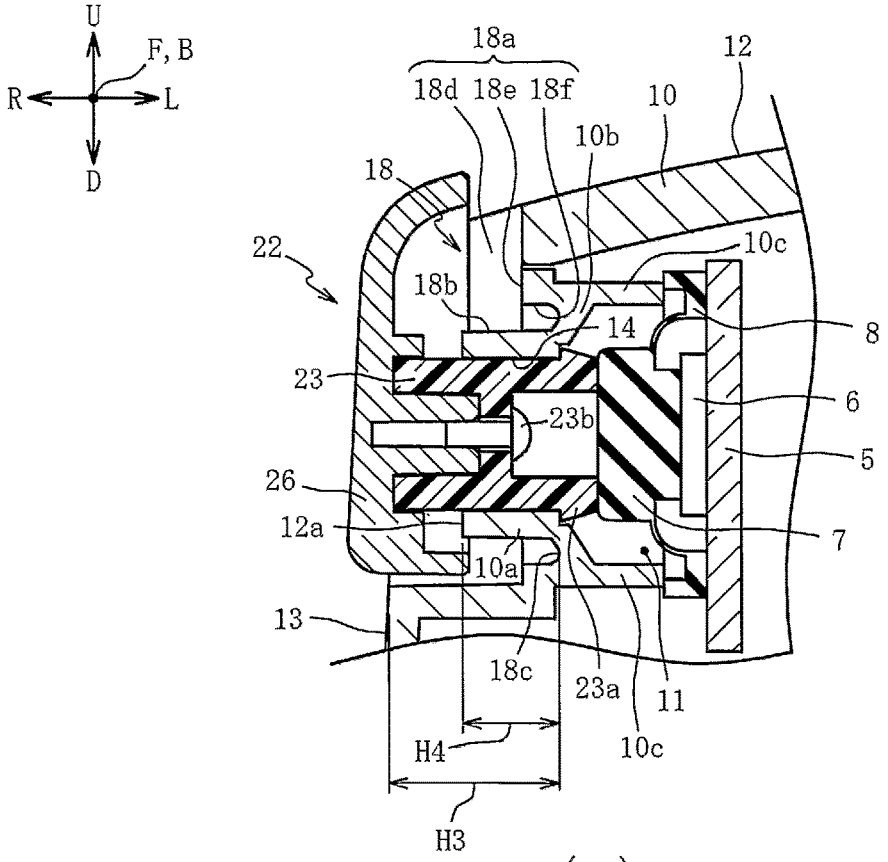
Figure 4:
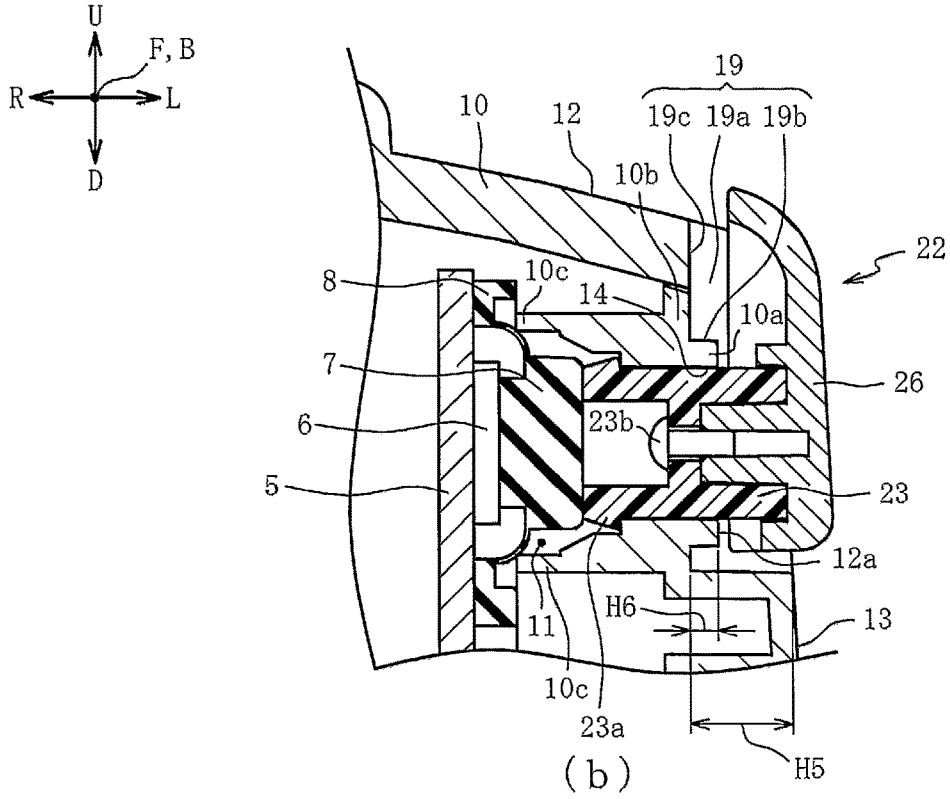

(a) of FIG. 4 is a cross-sectional view of the electronic wind instrument along a line IVa-Iva of FIG. 1. (b) of FIG. 4 is a cross-sectional view of the electronic wind instrument along a line IVb-IVb of FIG. 1.

Figure 5:
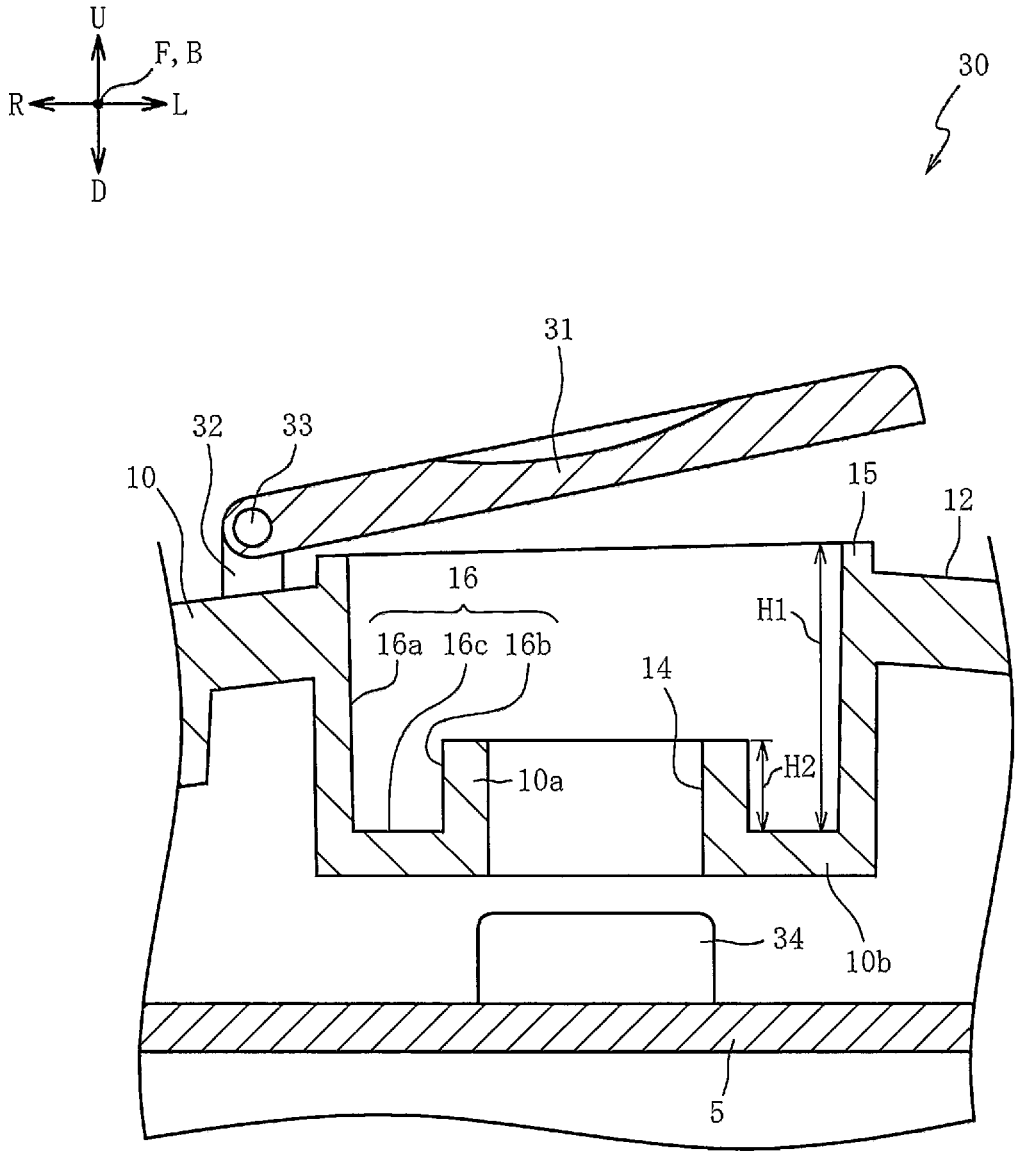

FIG. 5 is a cross-sectional view of an electronic wind instrument of a second embodiment.

DESCRIPTION OF EMBODIMENTS

Hereinafter, preferred embodiments will be described with reference to the accompanying drawings. First, an overall configuration of an electronic wind instrument 1 will be described with reference to FIG. 1. FIG. 1 is a plan view of the electronic wind instrument 1 of the first embodiment. The directions indicated by arrows U, D, F, B, L, and R in each drawing are respectively up, down, front, rear, left, and right directions of the electronic wind instrument 1. However, the up and down direction, the front and rear direction, and the left and right direction of the electronic wind instrument 1 do not necessarily match the up and down direction, the front and rear direction, and the left and right direction of the electronic wind instrument 1 when the electronic wind instrument is used.

As shown in FIG. 1, the electronic wind instrument 1 is an electronic musical instrument that resembles a saxophone which is a kind of wind instrument. The electronic wind instrument 1 includes an instrument body 10, a blow port 2, a plurality of operation pieces 20, 21, and 22, and an electronic component such as a breath sensor 4.

The instrument body 10 is an exterior and is formed long in the front and rear direction. The electronic component such as the breath sensor 4 is disposed in an internal space 11 of the instrument body 10 (see FIG. 2). The blow port 2 resembles a saxophone mouthpiece. The blow port 2 is attached to a rear end of the instrument body 10.

The exhaled breath of the performer is blown into the blow port 2 from the rear end. The breath sensor 4 detects the presence or absence and the strength of exhaled breath. The breath sensor 4 is a pressure sensor that detects a change in atmospheric pressure due to the blowing of exhaled breath into the blow port 2.

The operation pieces 20, 21, and 22 are key switches pushed by the performer toward the internal space 11. The plurality of operation pieces 20 each having a circular shape and the plurality of operation pieces 21 each having a square shape when viewed from the push-down direction (the up and down direction) are attached to an upper outer surface 12 of the instrument body 10. Further, the plurality of operation pieces 22 each having a square shape when viewed from the push-down direction (the left and right direction) are attached to both left and right outer surfaces 13 of the instrument body 10.

Figure 2:
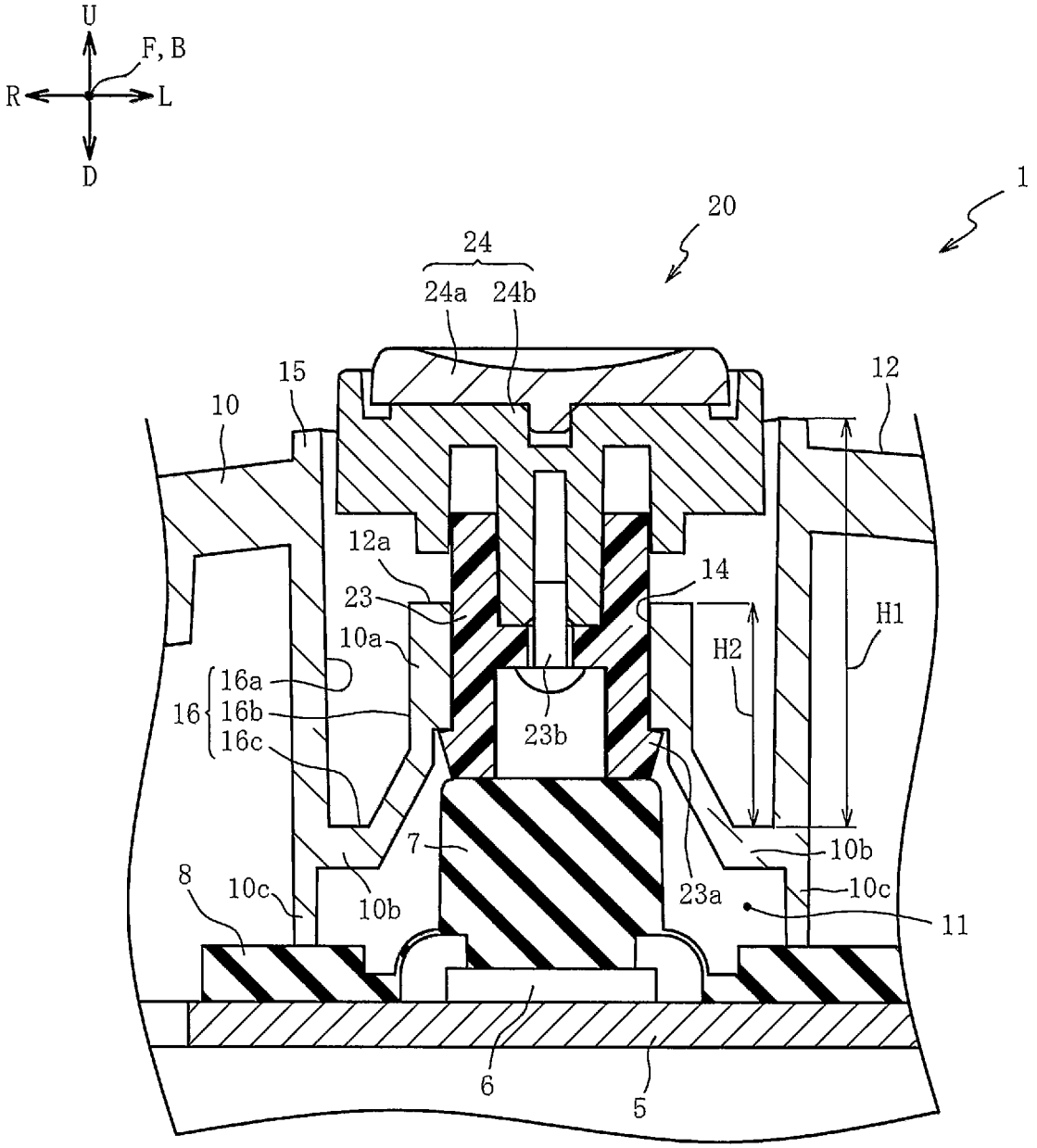
FIG. 2 is a cross-sectional view of the electronic wind instrument along a line II-II of FIG. 1.
Figure 3:
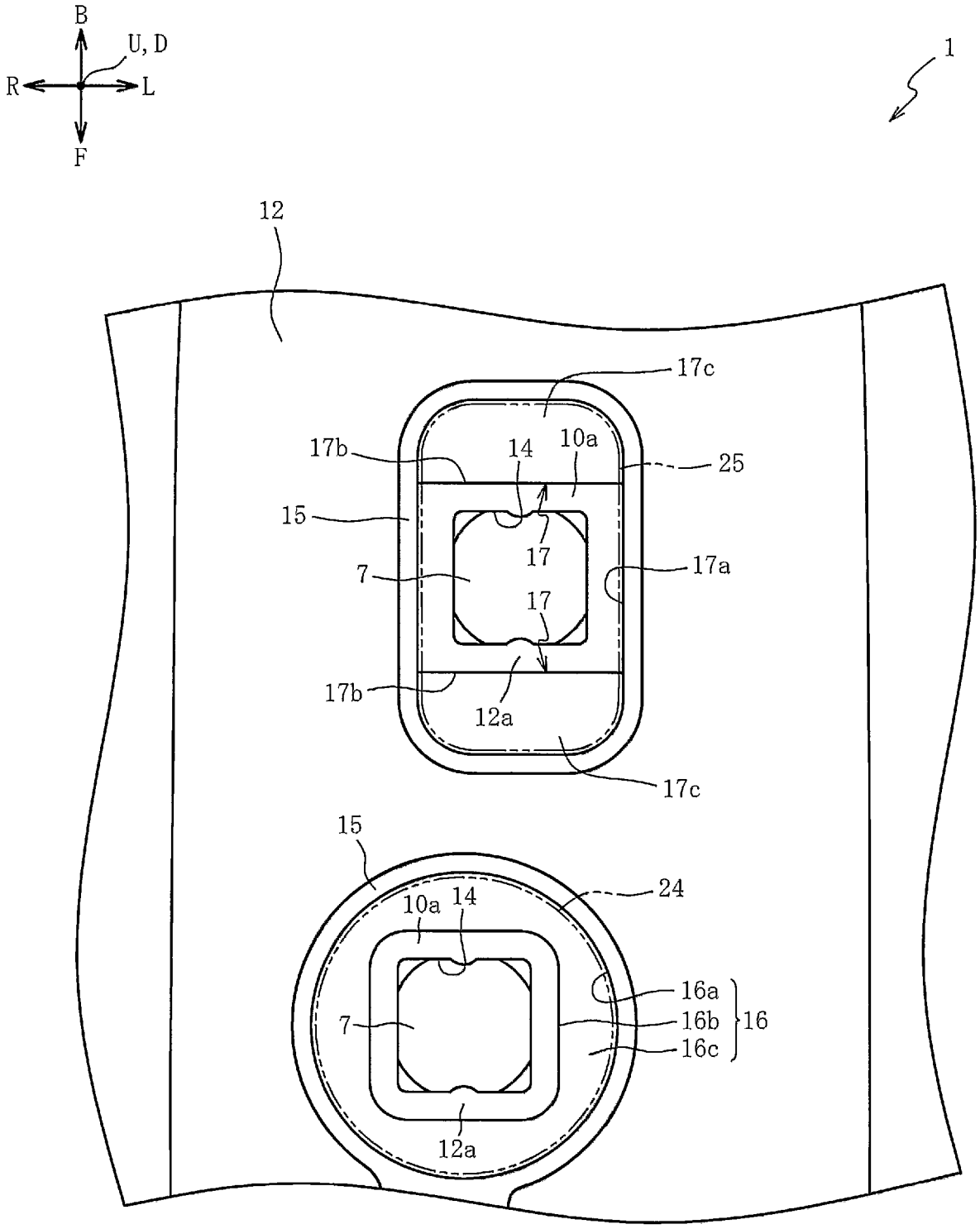
FIG. 3 is a plan view of an instrument body in which the periphery of a through-hole is enlarged.

Next, a structure around the operation pieces 20 and 21 will be described in detail with reference to FIGS. 2 and 3. FIG. 2 is a cross-sectional view of the electronic wind instrument 1 along a line II-II of FIG. 1. FIG. 3 is a plan view of the instrument body 10 in which the periphery of a through-hole 14 at the attachment positions of the operation pieces 20 and 21 is enlarged. Additionally, in FIG. 3, the outlines of operation units 24 and 25 (operation pieces 20 and 21) are indicated by a two-dotted chain line. Further, a structure around the operation pieces 21 and 22 is substantially the same as a structure around the operation piece 20 and the same parts will be denoted by the same reference numerals and will not be described again.

As shown in FIGS. 2 and 3, in the instrument body 10, the plurality of through-holes 14 which lead into the internal space 11 open on the outer surface 12. A protrusion part 15, a groove 16, and a contact surface 12*a* are provided in the entire circumference of the through-hole 14 on the outer surface 12 of the instrument body 10 at the attachment position of the operation piece 20. The protrusion part 15 is an annular part which protrudes upward (opposite to the internal space 11) with respect to the outside thereof.

The groove 16 is a part which depresses the inside of the protrusion part 15 downward (toward the internal space 11). The groove 16 includes an outer wall 16*a*, an inner wall 16*b*, and a groove bottom 16*c*. The outer wall 16*a* is a wall surface that faces toward the through-hole 14. An inner peripheral surface of the protrusion part 15 is a part of the outer wall 16*a*.

The inner wall 16*b* is a wall surface that faces toward the outer wall 16*a*. The inner wall 16*b* constitutes an outer peripheral surface of the cylindrical part 10*a*. An inner peripheral surface of the cylindrical part 10*a* which is a part of the instrument body 10 is an inner peripheral surface of the through-hole 14. A part of the outer wall 16*a* and the inner wall 16*b* is provided substantially in parallel to the push-down direction of the operation piece 20 (the penetrating direction of the through-hole 14).

The groove bottom 16*c* is a part which connects the lower ends of the outer wall 16*a* and the inner wall 16*b* (the ends nearest to the internal space 11). The groove bottom 16*c* is formed by the outer surface 12 of a bottom forming part 10*b* of the instrument body 10. The outer wall 16*a* and the inner wall 16*b* rise upward from the bottom forming part 10*b*. The groove bottom 16*c* and the bottom forming part 10*b* are provided in a direction substantially perpendicular to the push-down direction of the operation piece 20. A height H1 of the outer wall 16*a* from the groove bottom 16*c* is higher than a height H2 of the inner wall 16*b* from the groove bottom 16*c*.

The contact surface 12*a* is an upper end of the cylindrical part 10*a*. That is, the contact surface 12*a* is a part which connects an upper end of the inner wall 16*b* to an upper end of the inner peripheral surface of the through-hole 14. The contact surface 12*a* contacts a part of the operation piece 20 (the operation unit 24) when the operation piece 20 is pushed down so that the operation of further pushing down the operation piece 20 is prohibited (the same applies to the operation pieces 21 and 22).

The operation piece 20 includes a shaft part 23 and the operation unit 24. The shaft part 23 is a part which is inserted into the through-hole 14. The shaft part 23 slides in the axial direction with respect to the inner peripheral surface of the through-hole 14. The shaft part 23 is formed of a resin material having a self-lubricating property. As the resin material having a self-lubricating property, polyacetal, polyimide, and polytetrafluoroethylene are exemplified.

A claw 23*a* is provided in a lower end of the shaft part 23 to project in a direction perpendicular to the shaft. The claw 23*a* is hooked on the instrument body 10 nearest to the internal space 11 around the through-hole 14 (a lower end of the cylindrical part 10*a*) so that the shaft part 23 is not easily pulled out upward from the through-hole 14.

The operation unit 24 is a substantially disk-shaped part which is touched by the performer. The operation unit 24 is connected to the end of the shaft part 23 nearest to the outer surface 12 and projects outward in a direction perpendicular to the shaft part 23. The operation unit 24 is a separate component from the shaft part 23. The shaft part 23 is fixed to the operation unit 24 by a screw 23*b*.

The operation unit 24 is formed by integrating a first part 24*a* and a second part 24*b* by adhesion or the like. The first part 24*a* is a part which constitutes an upper surface of the operation unit 24 and is directly pushed by the performer. The second part 24*b* is a part to which the shaft part 23 is fixed while the entire circumference of the side surface of the first part 24*a* is surrounded. The first part 24*a* and the second part 24*b* are formed of synthetic resin and the surfaces thereof are painted or plated. By making the surface color and texture different between the first part 24*a* and the second part 24*b*, the appearance and feeling of the operation unit 24 can be improved.

The inner wall 16*b* is located within a range in which the operation unit 24 (the operation piece 20) is projected in the push-down direction of the operation piece 20. The entire circumference of the side surface of the operation unit 24 is surrounded by the outer wall 16*a*. Additionally, the side surface of the operation piece 20 or the operation unit 24 in this specification is an outer peripheral surface centered on the push-down direction of the operation piece 20 (the same applies to the operation pieces 21 and 22).

Electronic components such as a plurality of control boards 5 or a push-down sensor 6 are disposed in the internal space 11 of the instrument body 10. The control board 5 is fixed to the instrument body 10 in a direction substantially perpendicular to the axial direction of the shaft part 23. The control board 5 generates a musical tone signal on the basis of a detection value of the breath sensor 4 (see FIG. 1) and a detection value of the push-down sensor 6. Then, a musical tone is emitted from a speaker (not shown) attached to the instrument body 10 on the basis of the musical tone signal.

Additionally, the detection value of the push-down sensor 6 and the detection value of the breath sensor 4 may be output to an external sound source and a musical tone signal may be generated by the sound source. Further, a musical tone signal may be output to an external amplifier or speaker and a musical tone based on the musical tone signal may be emitted from the external speaker.

The push-down sensor 6 is a pressure-sensitive sensor which is provided in the control board 5 immediately below the shaft part 23 (the through-hole 14). The push-down sensor 6 is individually provided in each of the plurality of operation pieces 20, 21, and 22 (see FIG. 1). Then, the plurality of push-down sensors 6 detect the push-down states of the operation pieces 20, 21, and 22 by the performer.

An elastic body 7 which is formed of columnar rubber is interposed between each of the plurality of push-down sensors 6 and each of the plurality of shaft parts 23. The plurality of elastic bodies 7 are integrally molded with each other in a connection state by a rubber film 8. The elastic body 7 and the rubber film 8 are a part of the control board 5. The elastic body 7 and the rubber film 8 are provided on a surface of the control board 5 nearest to the through-hole 14 to cover a wiring or the like of the control board 5.

A wall part 10*c* is disposed in the entire circumference of the push-down sensor 6 on a surface of the control board 5 (the rubber film 8) nearest to the through-hole 14. The wall part 10*c* is a cylindrical part of which an upper end is integrally molded with the bottom forming part 10*b* of the instrument body 10 and a lower end thereof contacts the rubber film 8 of the control board 5.

When the performer pushes down the operation pieces 20, 21, and 22 at an initial position in which the claw 23*a* is hooked on the instrument body 10, the shaft part 23 moves toward the push-down sensor 6 so that a pressure is applied to the push-down sensor 6 through the elastic body 7. The push-down sensor 6 (the control board 5) determines that the operation pieces 20, 21, and 22 are pushed down by the performer when a pressure applied to the push-down sensor 6 exceeds a threshold value.

Additionally, when the operation of the performer pushing down the operation pieces 20, 21, and 22 is released, the operation pieces 20, 21, and 22 are pushed up by the elastic force of the elastic body 7 to be returned to an initial position. Further, the height of the elastic body 7 is appropriately set so that the operation pieces 20, 21, and 22 are maintained at an initial position in response to the distance from the control board 5 to the shaft part 23.

As shown in FIG. 3, the protrusion part 15 is provided in the entire circumference of the through-hole 14 in the outer surface 12 at the attachment position of the operation piece 21 (see FIG. 1). Additionally, the operation unit 25 of the operation piece 21 has the same configuration as the operation unit 24 except that the operation unit is formed in a square shape when viewed from the push-down direction of the operation piece 21 and the surface is integrally composed of a painted or plated synthetic resin.

The outer surface 12 at the attachment position of the operation piece 21 includes an outer wall 17*a*, an inner wall 17*b*, and a groove bottom 17*c* on the inside of the protrusion part 15 (nearest to the through-hole 14). The outer wall 17*a* is a wall surface that faces toward the through-hole 14. The outer wall 17*a* is provided in the entire circumference around the through-hole 14. The outer wall 17*a* surrounds the entire circumference of the side surface of the operation unit 25. The inner peripheral surface of the protrusion part 15 is a part of the outer wall 17*a*.

The inner wall 17*b* is a wall surface that faces toward the outer wall 17*a*. The inner wall 17*b* is located at both sides in the longitudinal direction of the square operation piece 21 with respect to the through-hole 14. Both edges of the inner wall 17*b* are connected to the outer wall 17*a*. The inner wall 17*b* is provided in a range in which the operation unit 25 (the operation piece 21) is projected in the push-down direction of the operation piece 21. The outer wall 17*a* and the inner wall 17*b* are substantially in parallel to the push-down direction of the operation piece 21.

The groove bottom 17*c* is a part which connects the lower ends of the part surrounded by the outer wall 17*a* and the inner wall 17*b*. The groove bottom 17*c* is substantially perpendicular to the push-down direction of the operation piece 21. The height H1 of the outer wall 17*a* from the groove bottom 17*c* is higher than the height H2 of the inner wall 17*b* from the groove bottom 17*c*. A gap between the outer wall 17*a* and the inner wall 17*b* connected to each other by the groove bottom 17*c* is a groove 17 provided in the outer surface 12. That is, the groove 17 is provided at both sides of the square operation piece 21 in the longitudinal direction with respect to the through-hole 14.

Next, a structure around the operation piece 22 will be described with reference to (a) and (b) of FIG. 4. (a) of FIG. 4 is a cross-sectional view of the electronic wind instrument 1 along a line IVa-Iva of FIG. 1. (b) of FIG. 4 is a cross-sectional view of the electronic wind instrument 1 along a line IVb-IVb of FIG. 1.

As shown in (a) and (b) of FIG. 4, the operation piece 22 is pushed down by the performer toward the internal space 11 (in the left and right direction). The operation piece 22 includes the shaft part 23 and an operation unit 26. The operation unit 26 has a shape slightly different from that of the operation unit 25 of the operation piece 21, but has substantially the same configuration.

As shown in (a) of FIG. 4, an outer surface 13 on the right side of the instrument body 10 includes an outer wall 18*a*, an inner wall 18*b*, and a groove bottom 18*c* around the through-hole 14. The outer wall 18*a* is a wall surface that faces the through-hole 14. The outer wall 18*a* includes a first surface 18*d*, a second surface 18*e*, and a third surface 18*f*.

The first surface 18*d* is a part which surrounds both front and rear sides and the lower side of the operation unit 26. The second surface 18*e* is a part connected to an edge of the first surface 18*d* nearest to the internal space 11. The third surface 18*f* is a part connected to the second surface 18*e* and located nearer to the through-hole 14 than the first surface 18*d*. The second surface 18*e* and the third surface 18*f* are provided in the entire circumference around the through-hole 14. The first surface 18*d* and the third surface 18*f* are provided substantially in parallel to the push-down direction of the operation piece 22. The second surface 18*e* is provided in a direction substantially perpendicular to the push-down direction of the operation piece 22.

The inner wall 18*b* is a wall surface that faces toward the outer wall 18*a*. The inner wall 18*b* is substantially parallel to the push-down direction of the operation piece 22. The inner wall 18*b* is provided in the entire circumference around the through-hole 14. The inner wall 18*b* and the third surface 18*f* are located in a range in which the operation unit 26 (the operation piece 22) is projected in the push-down direction of the operation piece 22.

The groove bottom 18*c* is a part which connects the ends of the third surface 18*f* and the inner wall 18*b* nearest to the internal space 11. The groove bottom 18*c* is substantially perpendicular to the push-down direction of the operation piece 22. A height H3 of the first surface 18*d* from the groove bottom 18*c* is higher than a height H4 of the inner wall 18*b* from the groove bottom 18*c*. A gap between the outer wall 18*a* and the inner wall 18*b* connected to each other by the groove bottom 18*c* is a groove 18 provided in the outer surface 13 on the right side of the instrument body 10.

As shown in (b) of FIG. 4, the outer surface 13 on the left side of the instrument body 10 includes an outer wall 19*a*, an inner wall 19*b*, and a groove bottom 19*c* around the through-hole 14. The outer wall 19*a* is a wall surface that faces toward the through-hole 14. The outer wall 19*a* surrounds both front and rear sides and the lower side of the operation unit 26.

The inner wall 19*b* is a wall surface that faces the side opposite to the through-hole 14. The inner wall 19*b* is provided in the entire circumference around the through-hole 14. A part of the inner wall 19*b* faces toward the outer wall 19*a*. The inner wall 19*b* is located in a range in which the operation unit 26 (the operation piece 22) is projected in the push-down direction of the operation piece 22. The outer wall 19*a* and the inner wall 19*b* are substantially parallel to the push-down direction of the operation piece 22.

The groove bottom 19*c* is a part which connects the ends of the outer wall 19*a* and the inner wall 19*b* nearest to the internal space 11. The groove bottom 19*c* is substantially perpendicular to the push-down direction of the operation piece 22. A height H5 of the outer wall 19*a* from the groove bottom 19*c* is higher than a height H6 of the inner wall 19*b* from the groove bottom 19*c*. A gap between the outer wall 19*a* and the inner wall 19*b* connected to each other by the groove bottom 19*c* is a groove 19 which is provided in the outer surface 13 on the left side of the instrument body 10.

As described above, since the electronic wind instrument 1 generates a musical tone when the performer blows exhaled breath into the blow port 2, moisture in the exhaled breath of the performer is condensed on the outer surfaces 12 and 13 of the instrument body 10 or saliva of the performer adheres to the outer surfaces 12 and 13. In some cases, such moisture may infiltrate the internal space 11 of the instrument body 10 through the through-holes 14 for the operation pieces 20, 21, and 22 along the outer surfaces 12 and 13. When moisture infiltrating the internal space 11 adheres to a part not covered with the rubber film 8 in the components or wirings (not shown) of the control board 5 along the elastic body 7 or the rubber film 8, there is concern that the components or wirings may corrode or short-circuit. In this way, there is concern that malfunctions or failures may occur in each part of the control board 5 due to the moisture infiltrating the internal space 11 from the through-hole 14.

The electronic wind instrument 1 of this embodiment can receive moisture along the outer surfaces 12 and 13 by the grooves 16, 17, 18, and 19 formed by the outer walls 16*a*, 17*a*, 18*a*, and 19*a*, the inner walls 16*b*, 17*b*, 18*b*, and 19*b*, and the groove bottoms 16*c*, 17*c*, 18*c*, and 19*c* provided around the through-hole 14. Accordingly, moisture can be impeded from infiltrating the internal space 11 through the through-holes 14 for the operation pieces 20, 21, and 22. As a result, it is possible to impede the malfunction or failure of the control board 5 due to the moisture infiltrating the internal space 11 through the through-hole 14.

Additionally, the amount of moisture due to saliva and condensation which is a problem in the electronic wind instrument 1 is small. Therefore, even when the electronic components such as the control board 5 are not waterproofed or the sealing material is not provided around the through-hole 14, the grooves 16, 17, 18, and 19 can sufficiently impede the malfunction or failure of the control board 5.

Further, since the amount of moisture due to saliva and condensation is small, the amount of moisture accumulated in the grooves 16, 17, 18, and 19 is also small and the accumulated moisture evaporates and disappears during and after the performance in many cases. Therefore, it is not necessary to provide discharge passages for discharging moisture in the grooves 16, 17, 18, and 19. Further, since the discharge passages are not provided, it is possible to prevent moisture from flowing into the grooves 16, 17, 18, and 19 from the outlets of the discharge passages even when the performer plays the electronic wind instrument 1 in various postures. Further, it is possible to prevent moisture that is about to be discharged from the grooves 16, 17, 18, and 19 from flowing back through the discharge passages.

Since the grooves 16, 18, and 19 are provided in the entire circumferences of the through-holes 14, moisture can be further impeded from infiltrating the through-holes 14 surrounded by the grooves 16, 18, and 19. Further, the annular protrusion part 15 which protrudes upward with respect to its outside is provided in the outer surface 12 of the outer wall 16*a* and the outer wall 17*a*. Accordingly, moisture that travels along the outer surface 12 toward the inside of the outer wall 16*a* and the outer wall 17*a* can be blocked by the protrusion part 15. As a result, moisture can be impeded from infiltrating the through-hole 14 surrounded by the protrusion part 15 (the outer wall 16*a* and the outer wall 17*a*).

In the groove 18, since the first surface 18*d* of the outer wall 18*a* is not on the upper side of the through-hole 14, moisture accumulated in the groove 18 can be discharged from a part without the first surface 18*d* according to the performer's body posture (the direction of the electronic wind instrument 1). As a result, moisture can be impeded from infiltrating the through-hole 14 surrounded by the groove 18. In the groove 19, since the outer wall 19*a* is not on the upper side of the through-hole 14, moisture accumulated in the groove 19 can be discharged from a part without the outer wall 19*a* according to the performer's body posture. As a result, moisture can be impeded from infiltrating the through-hole 14 surrounded by the groove 19.

Further, in the groove 18, a small groove is formed by the third surface 18*f* of the outer wall 18*a*, the inner wall 18*b*, and the groove bottom 18*c* so that the second surface 18*e* is depressed toward the internal space 11. Accordingly, moisture that has entered the groove 18 can be accumulated in the small groove without being immediately discharged from a part without the first surface 18*d*. As a result, since moisture can be impeded from coming out of the groove 18, it is possible to suppress moisture coming out of the groove 18 from infiltrating other through-holes 14 along the outer surfaces 12 and 13.

The inner walls 16*b*, 17*b*, 18*b*, and 19*b* are provided in a range in which the operation pieces 20, 21, and 22 are projected in the push-down direction. Therefore, the inner walls 16*b*, 17*b*, 18*b*, and 19*b* are hidden by the operation pieces 20, 21, and 22 and the inner walls 16*b*, 17*b*, 18*b*, and 19*b* can be difficult for the performer or the audience to see. Accordingly, it is difficult for the performer or the like to recognize the presence of the grooves 16, 17, 18, and 19 that receive moisture. As a result, it is possible to suppress deterioration of the appearance of the electronic wind instrument 1 due to the grooves 16, 17, 18, and 19.

Further, since it is possible to suppress deterioration of the appearance of the electronic wind instrument 1 due to the grooves 16, 17, 18, and 19 according to the positions of the inner walls 16*b*, 17*b*, 18*b*, and 19*b*, it is easy to deepen the grooves 16, 17, 18, and 19. Accordingly, since the amount of moisture accumulated in the deepened grooves 16, 17, 18, and 19 can be increased, moisture can be impeded from infiltrating the through-hole 14.

Since the side surfaces of the operation pieces 20, 21, and 22 (the operation units 24, 25, and 26) are surrounded by the outer walls 16*a*, 17*a*, 18*a*, and 19*a*, it is more difficult for the performer or the like to see the inner walls 16*b*, 17*b*, 18*b*, and 19*b*. Accordingly, it is possible to further suppress deterioration of the appearance of the electronic wind instrument 1 due to the grooves 16, 17, 18, and 19.

Particularly, the entire circumferences of the side surfaces of the operation pieces 20 and 21 are surrounded by the outer walls 16*a* and 17*a*. Therefore, the performer or the like can easily recognize that the lower ends of the outer walls 16*a* and 17*a* directly lead into the internal space 11. That is, the performer or the like can easily recognize that all inner peripheral sides of the outer walls 16*a* and 17*a* are the through-holes 14 formed in the instrument body 10. As a result, since it is more difficult for the performer or the like to recognize the presence of the grooves 16 and 17, it is possible to further suppress deterioration of the appearance of the electronic wind instrument 1 due to the grooves 16 and 17.

Further, since the inner peripheral surface of the annular protrusion part 15 which protrudes upward with respect to its outside is a part of the outer walls 16*a* and 17*a*, the performer or the like can easily recognize that all of the inner peripheral side of the protrusion part 15 becomes the through-hole 14 formed in the instrument body 10. Accordingly, since it is more difficult for the performer or the like to recognize the presence of the grooves 16 and 17, it is possible to further suppress deterioration of the appearance of the electronic wind instrument 1 due to the grooves 16 and 17.

At the time of operating (pushing and releasing) the operation pieces 20, 21, and 22, the shaft part 23 slides on the inner peripheral surface of the through-hole 14 (the inner peripheral surface of the cylindrical part 10*a*). Accordingly, the operation pieces 20, 21, and 22 can be operated smoothly.

Further, since the side surfaces of the operation units 24, 25, and 26 projecting outward in a direction perpendicular to the shaft part 23 are surrounded by the outer walls 16*a*, 17*a*, 18*a*, and 19*a*, it is difficult for the performer or the like to see the shaft part 23. Particularly, since the entire circumferences of the side surfaces of the operation units 24 and 25 are surrounded by the outer walls 16*a* and 17*a*, it is more difficult to see the shaft part 23. Further, since a part of the side surface of the operation unit 26 is not surrounded by the outer walls 18*a* and 19*a*, the shaft part 23 is seen from a gap between the operation unit 26 and the second surface 18*e* of the outer wall 18*a* or a gap between the operation unit 26 and the groove bottom 19*c*. However, since the inner walls 18*b* and 19*b* rise to the operation unit 26 with respect to the second surface 18*e* or the groove bottom 19*c*, it is difficult to see the shaft part 23 due to the inner walls 18*b* and 19*b*.

In this way, since it is difficult to see the shaft part 23, it is not necessary to paint or coat the shaft part 23 to improve the appearance. Although the film thickness of the painting or coating is likely to vary, the size of the shaft part 23 that rubs against the inner peripheral surface of the through-hole 14 can be managed without considering the film thickness. Thus, it is easy to manage the dimension of the shaft part 23 with respect to the through-hole 14.

Further, the inner walls 16*b*, 17*b*, 18*b*, and 19*b* are outer peripheral surfaces of the cylindrical part 10*a* and the shaft part 23 slides on the inner peripheral surface of the cylindrical part 10*a*. Accordingly, the inner walls 16*b*, 17*b*, 18*b*, and 19*b* can be brought closer to the through-hole 14 or the shaft part 23 so that the widths of the grooves 16, 17, 18, and 19 can be widened. As a result, it is possible to increase the volumes of the grooves 16, 17, 18, and 19 and to increase the amount of moisture accumulated in the grooves 16, 17, 18, and 19.

Since the shaft part 23 slides on the inner peripheral surface of the through-hole 14, the operation units 24, 25, and 26 cannot slide on the outer walls 16*a*, 17*a*, 18*a*, and 19*a*. Here, when the operation units 24, 25, and 26 slide on the outer walls 16*a*, 17*a*, 18*a*, and 19*a*, only a small amount of moisture adhering to the side surfaces of the operation units 24, 25, and 26 when the operation pieces 20, 21, and 22 are pushed down enters the grooves 16, 17, 18, and 19 and hence the moisture can be impeded from entering the grooves 16, 17, 18, and 19. However, in this case, there is almost no gap between the outer walls 16*a*, 17*a*, 18*a*, and 19*a* and the operation units 24, 25, and 26 and moisture evaporating in the grooves 16, 17, 18, and 19 is less likely to be discharged to the outside. Thus, moisture in the grooves 16, 17, 18, and 19 is less likely to evaporate or evaporated moisture is likely to condense in the grooves 16, 17, 18, and 19.

In contrast, in this embodiment, since the operation units 24, 25, and 26 do not slide on the outer walls 16*a*, 17*a*, 18*a*, and 19*a*, it is possible to secure a gap between the outer walls 16*a*, 17*a*, 18*a*, and 19*a* and the operation units 24, 25, and 26. Moisture evaporating in the grooves 16, 17, 18, and 19 can be discharged to the outside through the gap.

The shaft part 23 is formed of a resin material having a self-lubricating property. Accordingly, the shaft part 23 can be made slippery without painting or coating the shaft part 23 to make the shaft part 23 slippery. As a result, since it is not necessary to paint or coat the shaft part 23, it is possible to operate the operation pieces 20 more smoothly, 21, and 22 while facilitating the dimension management of the shaft part 23 with respect to the through-hole 14.

The operation units 24, 25, and 26 are separate components from the shaft part 23. Therefore, the operation units 24, 25, and 26 which are visible to the performer or the like can be easily decorated regardless of the slipperiness of the shaft part 23. For example, the operation units 24, 25, and 26 can be easily decorated in such a manner that the operation units 24, 25, and 26 are individually and easily painted or coated or the operation units 24, 25, and 26 are formed of a material which can be easily painted or coated.

The heights H1, H3, and H5 of the outer walls 16*a*, 17*a*, and 19*a* or the first surface 18*d* from the groove bottoms 16*c*, 17*c*, 18*c*, and 19*c* are higher than the heights H2, H4, and H6 of the inner walls 16*b*, 17*b*, 18*b*, and 19*b* on the inside thereof from the groove bottoms 16*c*, 17*c*, 18*c*, and 19*c*. Accordingly, the side surfaces of a part of the operation pieces 20, 21, and 22 located on the side opposite to the internal space 11 with respect to the inner walls 16*b*, 17*b*, 18*b*, and 19*b* can be easily surrounded by the outer walls 16*a*, 17*a*, and 19*a* or the first surface 18*d*. As a result, it is difficult to see the inner walls 16*b*, 17*b*, 18*b*, and 19*b* or the shaft part 23 by the outer walls 16*a*, 17*a*, and 19*a* or the first surface 18*d*.

Here, when the heights H1, H3, and H5 are respectively equal to or less than the heights H2, H4, and H6, it is necessary to drastically droop the side surfaces of the operation units 24, 25, and 26 toward the internal space 11 in order to surround the side surfaces of the operation units 24, 25, and 26 by the outer walls 16*a*, 17*a*, and 19*a* or the first surface 18*d*. However, in this embodiment, since the heights H1, H3, and H5 are respectively higher than the heights H2, H4, and H6, it is possible to simplify the shapes of the operation units 24, 25, and 26 of which the side surfaces are surrounded by the outer walls 16*a*, 17*a*, and 19*a* or the first surface 18*d*.

The wall part 10*c* is disposed in the control board 5 around the push-down sensor 6. Accordingly, even when moisture infiltrates the internal space 11 through a gap between the through-hole 14 and the shaft part 23, the moisture can be prevented from easily spreading by the wall part 10*c*. Particularly, since the wall part 10*c* is provided in the entire circumference of the push-down sensor 6, moisture infiltrating through the through-hole 14 can be easily retained inside the wall part 10*c*.

Further, the control board 5 facing the inside of the wall part 10*c* is formed such that substantially the entire surface is formed by the rubber film 8 and a wiring that is corroded or short-circuited by moisture is not exposed. As a result, the malfunction or failure of the control board 5 due to moisture can be impeded.

Since the upper end of the wall part 10*c* is integrally molded with the bottom forming part 10*b* of the instrument body 10 and the lower end of the wall part 10*c* contacts the rubber film 8 of the control board 5, moisture infiltrating the internal space 11 through the through-hole 14 can be retained inside the wall part 10*c*. As the wall part 10*c* is strongly pushed against the rubber film 8, moisture is not easily transmitted to the outside of the wall part 10*c* through a gap between the wall part 10*c* and the rubber film 8. Further, since the bottom forming part 10*b* forms the groove bottoms 16*c*, 17*c*, 18*c*, and 19*c* of the grooves 16, 17, 18, and 19 provided in the instrument body 10, the bottom forming part 10*b* is brought closer to the control board 5. Since the wall part 10*c* is integrally molded with the bottom forming part 10*b*, the vertical dimension of the wall part 10*c* (the dimension of the operation piece 20 in the push-down direction) can be decreased.

Next, a second embodiment will be described with reference to FIG. 5. In the first embodiment, a case has been described in which the shaft part 23 is inserted into the through-hole 14 and the operation pieces 20, 21, and 22 are attached to the instrument body 10. In contrast, in the second embodiment, a case in which an operation piece 31 is attached to the outer surface 12 of the instrument body 10 will be described. Additionally, the same parts as those of the first embodiment will be denoted by the same reference numerals and will not be described below. FIG. 5 is a cross-sectional view of an electronic wind instrument 30 of the second embodiment.

As shown in FIG. 5, the operation piece 31 of the electronic wind instrument 30 is a key switch which is pushed toward the internal space 11 of the instrument body 10 by the performer. The operation piece 31 is attached to a support leg 32 erected on the outer surface 12 of the instrument body 10 through a support shaft 33.

The operation piece 31 covers the upper side of the annular protrusion part 15 provided in the entire circumference around the through-hole 14 (the side opposite to the internal space 11). The operation piece 31 which is not pushed by the performer at the initial position has a gap with respect to the protrusion part 15. The initial position of the operation piece 31 is maintained by a spring (not shown). When the performer pushes down the operation piece 31 against the elastic force of the spring, the operation piece 31 rotates about the support shaft 33 to contact the entire circumference of the protrusion part 15.

A push-down sensor 34 is attached to the control board 5 disposed in the internal space 11 of the instrument body 10 at a position immediately below the through-hole 14. The push-down sensor 34 is an optical sensor that measures a distance from the operation piece 31. The push-down sensor 34 (the control board 5) determines that the operation piece 31 is pushed down by the performer when the push-down sensor 34 measures the distance to the operation piece 31 contacting the protrusion part 15.

In this way, even when the operation piece 31 is attached to the outer surface 12, it is necessary to provide the through-hole 14 in the instrument body 10 between the operation piece 31 and the push-down sensor 34 in order to detect the push-down state of the operation piece 31 by the push-down sensor 34 disposed in the internal space 11. Similarly to the first embodiment, also in the second embodiment, moisture transmitted along the outer surface 12 can be received by the groove 16 around the through-hole 14. Accordingly, moisture can be impeded from infiltrating the internal space 11 through the through-hole 14 for the operation piece 31. As a result, it is possible to impede the malfunction or failure of the push-down sensor 34 or the control board 5 due to the moisture infiltrating the internal space 11 through the through-hole 14.

Since the height H1 of the outer wall 16*a* from the groove bottom 16*c* is higher than the height H2 of the inner wall 16*b* from the groove bottom 16*c*, it is difficult to see the inner wall 16*b* due to the outer wall 16*a* even when the side surface of the operation piece 31 is not surrounded by the outer wall 16*a*. Accordingly, the performer or the like can easily recognize that the lower end of the outer wall 16*a* provided in the entire circumference of the through-hole 14 directly leads into the internal space 11. As a result, since it is possible for the performer or the like to recognize the presence of the groove 16, it is possible to suppress deterioration of the appearance of the electronic wind instrument 30 due to the groove 16.

The inner wall 16*b* and the outer wall 16*a* (the entire groove 16) are located in a range in which the operation piece 31 is projected in the push-down direction of the operation piece 31 (the penetrating direction of the through-hole 14). Accordingly, since the groove 16 is hidden by the operation piece 31, it is more difficult for the performer or the like to recognize the presence of the groove 16. As a result, it is possible to further suppress deterioration of the appearance of the electronic wind instrument 30 due to the groove 16.

Although a description has been made on the basis of the above-described embodiments, the invention is not limited to the above-described embodiments and can be easily modified into various forms within the scope not departing from the spirit of the invention. For example, the shape, dimension, and material of each part of the electronic wind instruments 1 and 30 may be appropriately changed. The electronic wind instruments 1 and 30 are not limited to electronic musical instruments that resemble saxophones, but may be electronic musical instruments that resemble wind instruments other than a saxophone. Further, the number and the like of the operation pieces 20, 21, and 22 may be appropriately changed. Further, the cross-sectional shapes of the grooves 16, 17, 18, and 19 may be, for example, U-shapes or V-shapes. Additionally, in the case of the V-shaped groove, the groove bottom is provided linearly.

In the first embodiment, a case has been described in which the shaft part 23 is formed of a resin material having a self-lubricating property, but the invention is not limited thereto. The shaft part 23 may be formed of a resin material or a metal material not having a self-lubricating property. Further, at least a part that rubs against the inner peripheral surface of the through-hole 14 of the shaft part 23 may be formed of a resin material having a self-lubricating property and the materials of the other parts may be appropriately changed. Also in this case, the shaft part 23 can be slippery with respect to the inner peripheral surface of the through-hole 14. Further, all or part of the shaft part 23 may be integrally molded with the operation units 24, 25, and 26.

In the first embodiment, a case in which the push-down sensor 6 is the pressure-sensitive sensor has been described. Further, in the second embodiment, a case in which the push-down sensor 34 is an optical sensor that detects a distance has been described. However, the invention is not limited thereto. As long as it is possible to detect the operation of the performer pushing down the operation pieces 20, 21, 22, and 31, the detailed configuration of the operation pieces 20, 21, 22, and 31 or the type of push-down sensor may be appropriately changed. For example, examples of the push-down sensor include a switch which connects a circuit by bringing a conductor provided on the lower surface of the elastic body 7 (the surface on the side opposite to the operation pieces 20, 21, and 22) into contact with two contacts points provided in the control board 5 by the push-down operation of the operation pieces 20, 21, and 22. Further, a sensor that measures the distance to the operation pieces 20, 21, 22, and 31 by changes in capacitance or reflection of ultrasonic waves may be used as the push-down sensor. Further, optical sensors that detect the presence or absence of an object therebetween may be provided as the push-down sensors and light shielding plates provided in the operation pieces 20, 21, 22, and 31 may enter between the facing push-down sensors during the push-down operation.

Additionally, since the elastic body 7 is not necessary with some types of push-down sensors as in the second embodiment, the rubber film 8 may not be provided in the control board 5. Also in such a case, the wall part 10*c* may be disposed on the control board 5 around the push-down sensor. Accordingly, moisture infiltrating through the through-hole 14 can be impeded from spreading by the wall part 10*c*. Further, the corrosion or short-circuit of the control board 5 inside the wall part 10*c* may be impeded by the arrangement of each part or wiring of the control board 5 inside the wall part 10*c* or the coating or the like of the control board 5 on the inside thereof. Accordingly, it is possible to further impede the malfunction or failure of the control board 5 due to moisture.

The invention is not limited to a case in which the wall part 10*c* is disposed in the entire circumference of the push-down sensor and the wall part 10*c* may be disposed in a part of the circumference of the push-down sensor. Further, the push-down sensor may be provided in a support member other than the control board 5 disposed in the internal space 11 and the wall part 10*c* may be disposed in a support member near the push-down sensor. The support member such as the control board 5 or the rubber film 8 may be integrally molded with the wall part 10*c* or the support member and the bottom forming part 10*b* may be formed as separate members from the wall part 10*c*. Further, a part of the instrument body 10 other than the bottom forming part 10*b* and the wall part 10*c* may be integrally molded with each other.

A gap may be formed between the wall part 10*c* and the instrument body 10 (the bottom forming part 10*b* or the like). Also in this case, moisture infiltrating the internal space 11 along the shaft part 23 or the like can be retained inside the wall part 10*c*. However, moisture can be guided to the inside of the wall part 10*c* along the inner peripheral surface of the through-hole 14 or the bottom forming part 10*b* by not providing a gap between the wall part 10*c* and the instrument body 10. Further, the bottom forming part 10*b* may be brought into contact with the support member by omitting the wall part 10*c* and deepening the groove 16 and the like. In this case, a part of the bottom forming part 10*b* is a wall part.

In the first embodiment, a case has been described in which the rubber elastic body 7 is interposed between the shaft part 23 and the push-down sensor 6, but the invention is not limited thereto. A coil spring, a leaf spring, a thermoplastic elastomer, or the like may be used for the elastic body 7. Further, when the push-down sensor 6 is not the pressure-sensitive sensor, an elastic body which returns the pushed operation pieces 20, 21, and 22 to the initial position may be provided between the push-down sensor 6 and the contact surface 12*a*, or between the push-down sensor 6 and the groove bottoms 16*c*, 17*c*, 18*c*, and 19*c*.

In the above-described embodiments, a case has been described in which the heights H1, H3, and H5 of the outer walls 16*a*, 17*a*, and 19*a* or the first surface 18*d* are higher than the heights H2, H4, and H6 of the inner walls 16*b*, 17*b*, 18*b*, and 19*b* on the inside thereof, but the invention is not limited thereto. The heights H2, H4, and H6 may be higher than the heights H1, H3, and H5. In this case, moisture can be impeded from infiltrating the through-hole 14 over the inner walls 16*b*, 17*b*, 18*b*, and 19*b* of the heights H2, H4, and H6.

In the above-described embodiments, a case has been described in which the inner walls 16*b*, 17*b*, 18*b*, and 19*b* are located in a range in which the operation pieces 20, 21, 22, and 31 are projected in the push-down direction (the penetrating direction of the through-hole 14), but the invention is not limited thereto. The inner walls 16*b*, 17*b*, 18*b*, and 19*b* may be provided in a range in which the operation pieces 20, 21, 22, and 31 are projected in the push-down direction (the penetrating direction of the through-hole 14). In this case, the amount of moisture accumulated in the grooves 16, 17, 18, and 19 can be easily checked and the moisture accumulated in the grooves 16, 17, 18, and 19 can be easily wiped off. As a result, moisture is not easily transmitted to the inside of the grooves 16, 17, 18, and 19 (the side of the through-hole 14).

REFERENCE SIGNS LIST

1, 30 Electronic wind instrument
4 Breath sensor (one electronic component)
5 Control board (one electronic component, support member)
6, 34 Push-down sensor
10 Instrument body
10*b* Bottom forming part
10*c* Wall part
11 Internal space
12, 13 Outer surface
14 Through-hole
16*a*, 17*a*, 18*a*, 19*a* Outer wall
16*b*, 17*b*, 18*b*, 19*b* Inner wall
16*c*, 17*c*, 18*c*, 19*c* Groove bottom
20, 21, 22, 31 Operation piece
23 Shaft part
24, 25, 26 Operation unit

The invention claimed is:

1. An electronic wind instrument, comprising:

an instrument body, a through-hole leading into an internal space and opening on an outer surface of the instrument body;

an operation piece, including a shaft part and an operation unit, attached to the instrument body at a position of the through-hole and pushed down toward the internal space; and an electronic component, disposed in the internal space, wherein the electronic component includes a push-down sensor which detects a push-down state of the operation piece, and wherein the outer surface of the instrument body includes an outer wall which surrounds a side surface of the operation piece and which is provided around the through-hole and faces toward the through-hole, an inner wall which is provided nearer to the through-hole than the outer wall and faces toward the outer wall, and a groove bottom which connects the outer wall and the inner wall, wherein the shaft part is a part which is inserted into the through-hole, the inner wall is provided in a range in which the operation unit is projected in a push-down direction of the operation piece, and an entire circumference of a side surface of the operation unit is surrounded by the outer wall.

2. The electronic wind instrument according to claim 1, wherein a height of the outer wall from the groove bottom is higher than a height of the inner wall from the groove bottom.

3. The electronic wind instrument according to claim 1, wherein the shaft part is formed such that at least a part that rubs against the inner peripheral surface of the through-hole is formed of a resin material having a self-lubricating property.

4. The electronic wind instrument according to claim 1, wherein the operation unit is a separate component from the shaft part.

5. The electronic wind instrument according to claim 1, further comprising:

a support member, disposed in the internal space and provided with the push-down sensor; and a wall part, disposed in the support member around the push-down sensor.

6. The electronic wind instrument according to claim 5, wherein the instrument body includes a bottom forming part which forms the groove bottom by the outer surface, and wherein the wall part is integrally molded with the bottom forming part and is in contact with the support member.

7. A method for manufacturing electronic wind instrument, comprising:

providing an instrument body, wherein a through-hole leading into an internal space opens on an outer surface of the instrument body;

attaching an operation piece, which includes a shaft part and an operation unit, to the instrument body at a position of the through-hole, wherein the operation piece is configured to be pushed down toward the internal space;

disposing an electronic component in the internal space, wherein the electronic component includes a push-down sensor which detects a push-down state of the operation piece;

providing an outer wall on the outer surface of the instrument body around the through-hole and facing toward the through-hole such that the outer wall surrounds a side surface of the operation piece;

providing an inner wall which is nearer to the through-hole than the outer wall and faces toward the outer wall; and providing a groove bottom which connects the outer wall and the inner wall, wherein the shaft part is a part which is inserted into the through-hole, providing the inner wall in a range in which the operation unit is projected in a push-down direction of the operation piece, and an entire circumference of a side surface of the operation unit is surrounded by the outer wall.

8. The method for manufacturing electronic wind instrument according to claim 7, further comprising providing the outer wall such that a height of the outer wall from the groove bottom is higher than a height of the inner wall from the groove bottom.

9. The method for manufacturing electronic wind instrument according to claim 7, wherein the shaft part is formed such that at least a part that rubs against the inner peripheral surface of the through-hole is formed of a resin material having a self-lubricating property.

10. The method for manufacturing electronic wind instrument according to claim 7, further comprising providing the operation unit which is a separate component from the shaft part.

11. The method for manufacturing electronic wind instrument according to claim 7, further comprising:

disposing a support member in the internal space, wherein the support member is provided with the push-down sensor; and disposing a wall part in the support member around the push-down sensor.

12. The method for manufacturing electronic wind instrument according to claim 11, further comprising providing the instrument body which includes a bottom forming part which forms the groove bottom by the outer surface, and forming the wall part to be integrally molded with the bottom forming part and to be in contact with the support member.

* * * * *